US008915765B2

(12) United States Patent
Chayet et al.

(10) Patent No.: US 8,915,765 B2
(45) Date of Patent: Dec. 23, 2014

(54) GARMENT WITH SUPPORT BACK-WING

(75) Inventors: Sagit Chayet, Haifa (IL); Eli Almog, Kfar Saba (IL)

(73) Assignee: Delta Galil Industries Ltd., Karmiel (IL)

( * ) Notice: Subject to any disclaimer, the term of this patent is extended or adjusted under 35 U.S.C. 154(b) by 0 days.

(21) Appl. No.: 14/000,604

(22) PCT Filed: Apr. 4, 2012

(86) PCT No.: PCT/IB2012/051670

§ 371 (c)(1), (2), (4) Date: Aug. 21, 2013

(87) PCT Pub. No.: WO2012/137154

PCT Pub. Date: Oct. 11, 2012

(65) Prior Publication Data

US 2014/0235139 A1 Aug. 21, 2014

Related U.S. Application Data

(60) Provisional application No. 61/471,741, filed on Apr. 5, 2011.

(51) Int. Cl.

| | |
|---|---|
| ***A41C 3/00*** | (2006.01) |
| ***A41C 1/00*** | (2006.01) |
| ***A41C 3/06*** | (2006.01) |

(52) U.S. Cl.

CPC ..... *A41C 3/0057* (2013.01); *A41C 1/003* (2013.01); *A41C 3/0028* (2013.01); *A41C 3/06* (2013.01); *A41B 2400/38* (2013.01); *A41B 2400/82* (2013.01)

USPC ..... 450/66; 450/75; 450/92

(58) Field of Classification Search

USPC ..... 450/75, 92, 20, 21, 34, 65–73, 76, 86, 450/88; 2/67; 66/171, 177, 176, 153, 170, 66/172 E

See application file for complete search history.

(56) References Cited

U.S. PATENT DOCUMENTS

| | | | | |
|---|---|---|---|---|
| 2,949,115 | A | 8/1960 | Phillips | |
| 3,093,137 | A * | 6/1963 | Dugan | 450/19 |
| 3,173,421 | A * | 3/1965 | Steiner | 450/61 |
| 3,392,732 | A | 7/1968 | Holscher | |
| 3,411,510 | A * | 11/1968 | Child | 450/70 |
| 3,566,878 | A * | 3/1971 | Radomski | 450/65 |
| 3,606,891 | A * | 9/1971 | Marcario et al. | 450/3 |
| 4,340,064 | A * | 7/1982 | Vale | 450/72 |
| 5,167,566 | A | 12/1992 | Novitsky et al. | |
| 7,169,011 | B2 | 1/2007 | Mitchell et al. | |
| 2005/0136797 | A1 * | 6/2005 | Mitchell et al. | 450/60 |

OTHER PUBLICATIONS

International Search Report for corresponding PCT application PCT/IB2012/051670 mailed on Sep. 11, 2012.

* cited by examiner

*Primary Examiner* — Gloria Hale

(74) *Attorney, Agent, or Firm* — Eitan, Mehulal & Sadot

(57) ABSTRACT

The present invention includes a garment, such as a bra or a shaper, having regions of differential elasticity. For example, a bra includes: two cups located at a front side of the bra; and a backwing comprising a plurality of regions having differential elasticity. Optionally, the plurality of regions comprise at least five areas which comprise: a central area having reduced elasticity; a right-side area having increased elasticity; a left side area having increased elasticity; a first intermediary area, located between the central area and the right-side area, wherein the first intermediary area has intermediate elasticity; and a second intermediary area, located between the central area and the left-side area, wherein the second intermediary area has intermediate elasticity.

13 Claims, 7 Drawing Sheets

GARMENT WITH SUPPORT BACK-WING

PRIOR APPLICATION DATA

This application is a National Phase of PCT International Application Number PCT/IB2012/051670, entitled "Garment with Support Back-Wing", filed on Apr. 4, 2012, published as International Publication Number WO 2012/137154, which is incorporated herein by reference in its entirety; and which claims priority and benefit from U.S. provisional patent application 61/471,741, entitled "Garment with Support Back-Wing", filed on Apr. 5, 2011, which is incorporated herein by reference in its entirety.

FIELD OF THE INVENTION

The present invention relates to the field of articles of clothing.

BACKGROUND

A brassiere, commonly referred to as a bra, is an undergarment able to support a female's breasts. A bra may provide to its user support and comfort, particularly during a physical activity, for example, running or exercising.

Some bras may provide other functions or features. For example, a "push-up" bra may modify the shape or may increase the perceived size of breasts. Conversely, some bras may be form-fitting and may minimize breasts size.

Some articles of clothing may include integrated breasts support. Such garments may include, for example, a camisole, a tank top, or some type of dresses, which may obviate the need to wear a separate bra.

SUMMARY

The present invention may include, for example, a bra including a backwing having differential elasticity, differential rigidness, or differential support. For example, side-areas of the backwing may have increased elasticity or reduced support, whereas a central area of the backwing may have reduces elasticity or increased support.

The present invention may include other type of garments, for example, a shaper garment, which may include a support band or support belt having a front side and a back side. The back side may have differential elasticity, differential rigidness, or differential support. For example, side-areas of the back side may have increased elasticity or reduced support, whereas a central area of the back side may have reduced elasticity or increased support.

The present invention may include a bra which may include: two cups located at a front side of the bra; and a backwing which may include multiple areas having differential elasticity or differential firmness.

The present invention may include a shaper garment which may include: a generally ring-shaped support band comprising a front area and a back area, wherein the back area may include multiple areas having differential elasticity or differential firmness.

The present invention may provide other and/or additional benefits or advantages.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION OF THE INVENTION

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

The applicants have realized that a band or back-wing of a garment (e.g., bra or brassier), which has continuous, uniform elasticity, does not provide sufficient strength or support in order to hold the garment against a generally straight portion of the body (e.g., a back of a person). The applicants have further realized that it may be advantageous or beneficial to produce a garment (e.g., bra or brassiere) which may include a back-wing having changing elasticity, non-uniform elasticity, non-continuous elasticity, differential elasticity, gradually-changing elasticity, or other types of differential elasticity, in order to provide strength and/or support at the appropriate one or more locations of the user's body.

The invention may include, for example, a bra or brassier, as well as methods and systems for manufacturing of bras or brassieres or other suitable types of clothing. The invention may include a strapless bra, as well as a bra having shoulder strap(s), or other suitable types of garments, e.g., shapers, lingerie items, underwear, or undergarments.

Figure 1B:
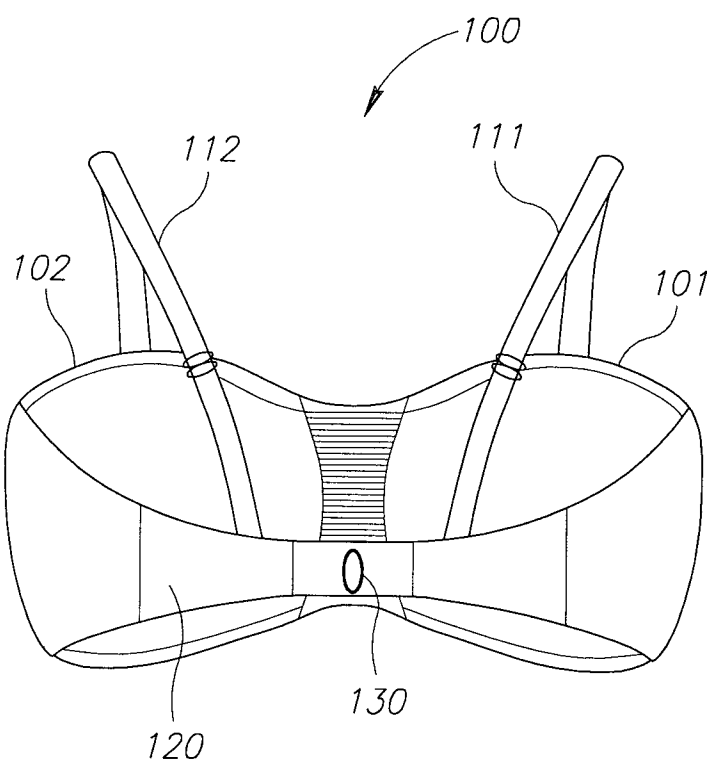
FIGS. 1A and 1B are schematic illustrations of a back-closing strapped bra showing a front view (FIG. 1A) and a rear view (FIG. 1B) thereof, in accordance with some embodiments of the present invention.
Figure 1A:
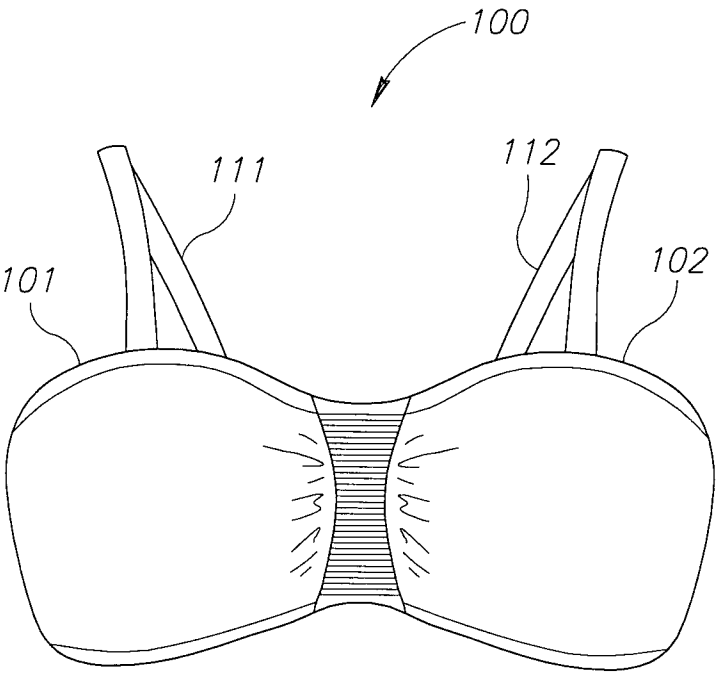

Reference is made to FIGS. 1A and 1B, which are schematic illustrations of a back-closing strapped bra 100 showing a front view (FIG. 1A) and a rear view (FIG. 1B) thereof, in accordance with some embodiments of the invention. Bra 100 may include two cups 101-102 and a back wing 120. Bra 100 may optionally include two straps 111-112. The back wing 120 may include a closing/opening mechanism 130, for example, hooks, knots, Velcro, or other suitable mechanisms.

Figure 2A:
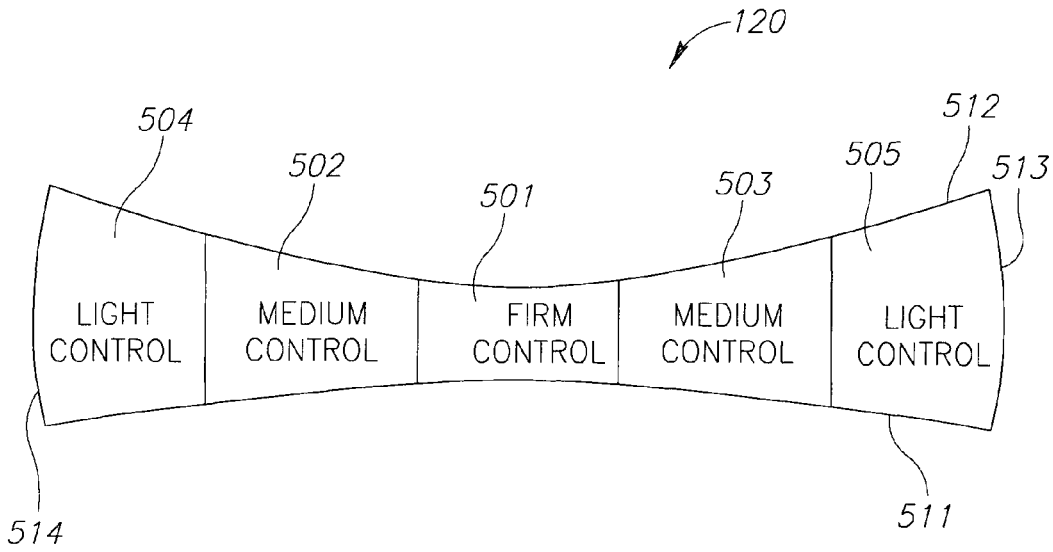
FIGS. 2A and 2B are schematic illustrations of back wing, showing a first view (FIG. 2A) and a second, opposite, view (FIG. 2B) thereof, in accordance with some embodiments of the present invention.
Figure 2B:
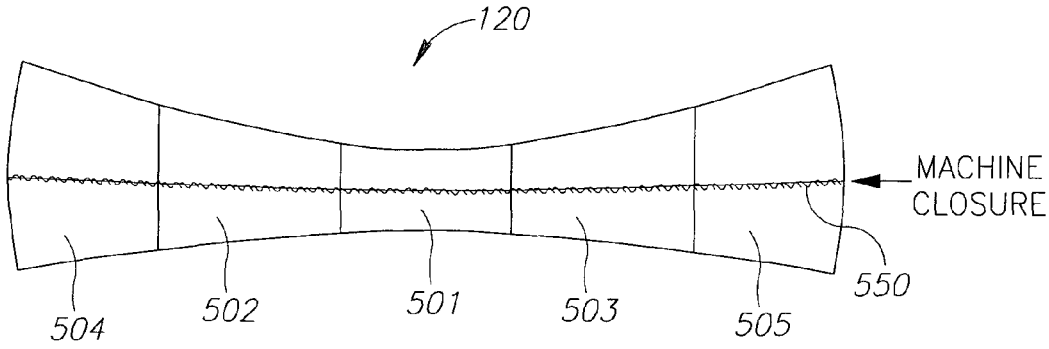

Reference is made to FIGS. 2A and 2B, which are schematic illustrations of back wing 120, showing a first view (FIG. 2A) and a second, opposite, view (FIG. 2B) thereof, in accordance with some embodiments of the invention.

Back wing 120 may be formed, for example, to have a four-side contour which may include two long concave arcs 511-512 opposite to each other, and two shorter convex arcs 513-514 opposite to each other. The back wing 120 may be formed as a single unit which may include multiple areas having multiple levels of resistance, support, elasticity, rigidness, flexibility, or similar characteristics. For example, a first area, which may be referred to as central area 501 of the back wing 120 may be less flexible and more rigid, and may provide firm support; one or more other areas (for example, a left-side intermediary area 502, and a right-side intermediary area 503) may have medium flexibility and may provide medium support; and one or more areas (for example, a leftmost area 504, and a rightmost area 505) may have little flexibility and may provide light or reduced support.

Optionally, the various areas (the central area 501, the left-side intermediary area 502, the right-side intermediary area 503, the leftmost area 504, and the rightmost area 505) may be arranged in a symmetrical pattern, such that the central area 501 which provides firm support, may be bordering a medium support area (left-side intermediary area 502), and another medium support area (right-side intermediary area 503), which in turn may be further bordering, on their opposite sides, a light support area (leftmost area 504) and another light support area (rightmost area 505), respectively.

The back wing 120 may be formed to provide gradually-decreasing rigidness or support from the central area 501 outwards or sideways; or to provide gradually-increasing flexibility or elasticity from the central area 501 outwards or sideways.

Optionally, the internal side of back wing 120 (namely, the side which may not face outward when the back wing 120 if worn, but rather, may face towards the person's body), may include a machine closure line 550, which may be a knitting line or sewing line which may run along the back wing 550, for example, closing or stitching together two layers of fabric from which back wing 120 may be formed.

Figure 3B:
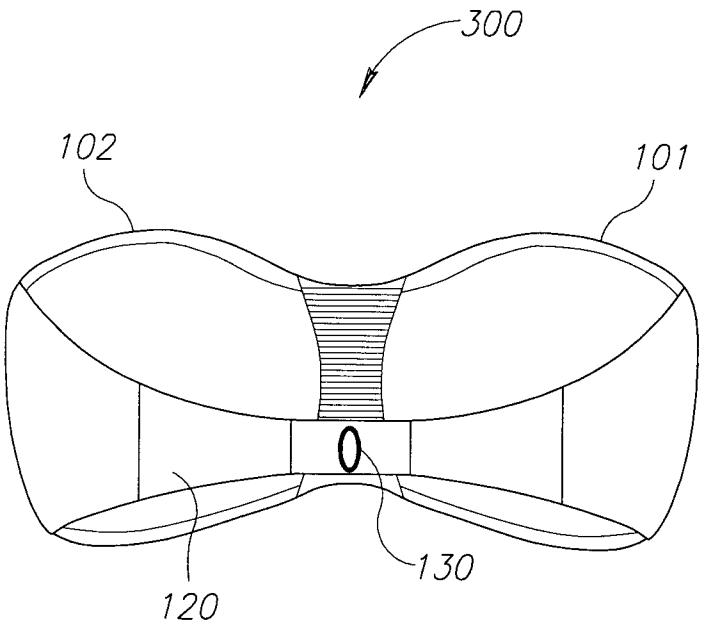
FIGS. 3A and 3B are schematic illustrations of a back-closing strapless bra showing a front view (FIG. 3A) and a rear view (FIG. 3B) thereof, in accordance with some embodiments of the present invention.
Figure 3A:
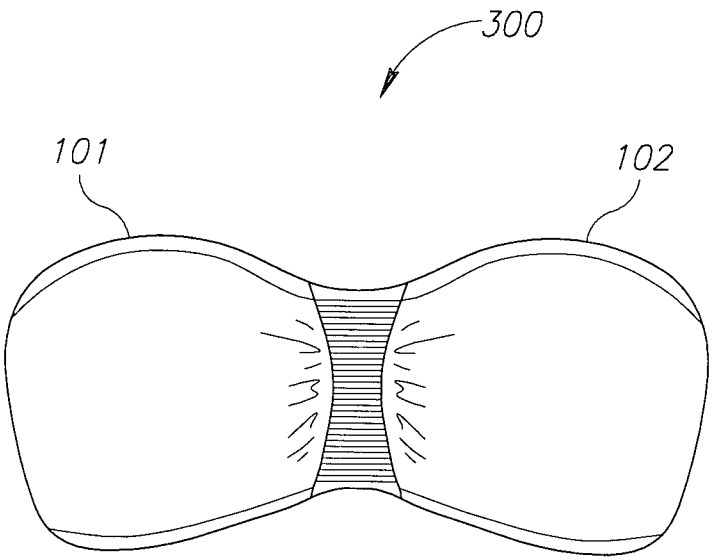

Reference is made to FIGS. 3A and 3B, which are schematic illustrations of a back-closing strapless bra 300 showing a front view (FIG. 3A) and a rear view (FIG. 3B) thereof, in accordance with some embodiments of the invention. Bra 300 may include two cups 101-102 and back wing 120. Bra 300 may be a strapless bra, and may not include shoulder straps. The back wing 120 may include a closing/opening mechanism 130, for example, hooks, knots, Velcro, or other suitable mechanisms.

Figure 4A:
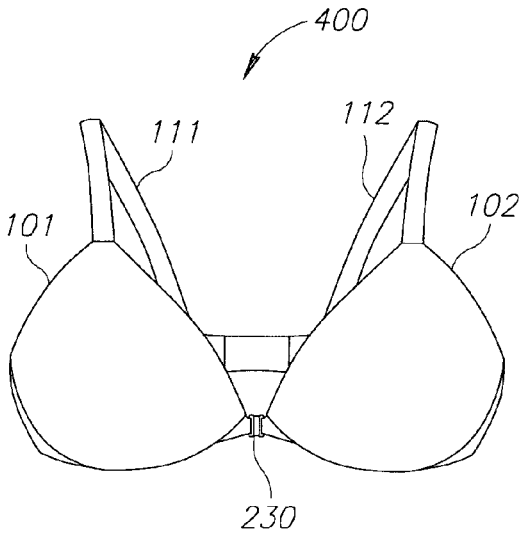
FIGS. 4A and 4B are schematic illustrations of a front-closing strapped bra showing a front view (FIG. 4A) and a rear view (FIG. 4B) thereof, in accordance with some embodiments of the present invention.
Figure 4B:
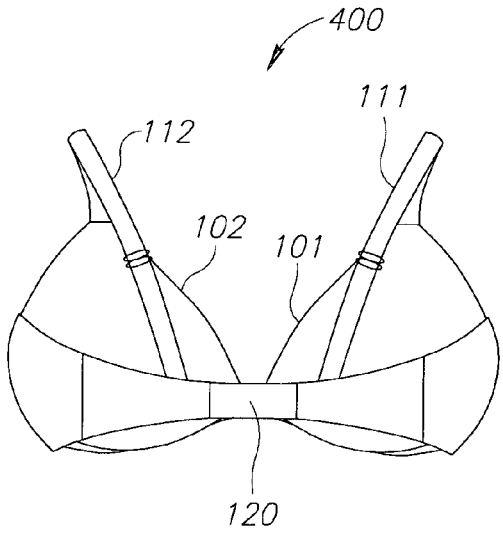

Reference is made to FIGS. 4A and 4B, which are schematic illustrations of a front-closing strapped bra 400 showing a front view (FIG. 4A) and a rear view (FIG. 4B) thereof, in accordance with some embodiments of the invention. Bra 400 may include two cups 101-102 and back wing 120. Bra 400 may optionally include two straps 111-112. The two cups 101-102 may be interconnected using a closing/opening mechanism 230, for example, hooks, knots, Velcro, or other suitable mechanisms.

Figure 5A:
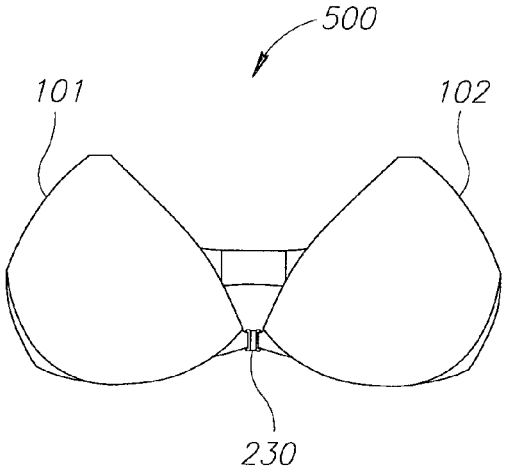
FIGS. 5A and 5B are schematic illustrations of a front-closing strapless bra showing a front view (FIG. 5A) and a rear view (FIG. 5B) thereof, in accordance with some embodiments of the present invention.
Figure 5B:
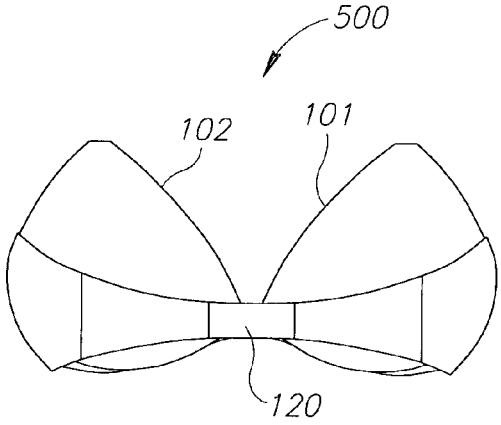

Reference is made to FIGS. 5A and 5B, which are schematic illustrations of a front-closing strapless bra 500 showing a front view (FIG. 5A) and a rear view (FIG. 5B) thereof, in accordance with some embodiments of the invention. Bra 500 may include two cups 101-102 and back wing 120. Bra 500 may be a strapless bra, and may not include shoulder straps. The two cups 101-102 may be interconnected using closing/opening mechanism 230, for example, hooks, knots, Velcro, or other suitable mechanisms.

Figure 6A:
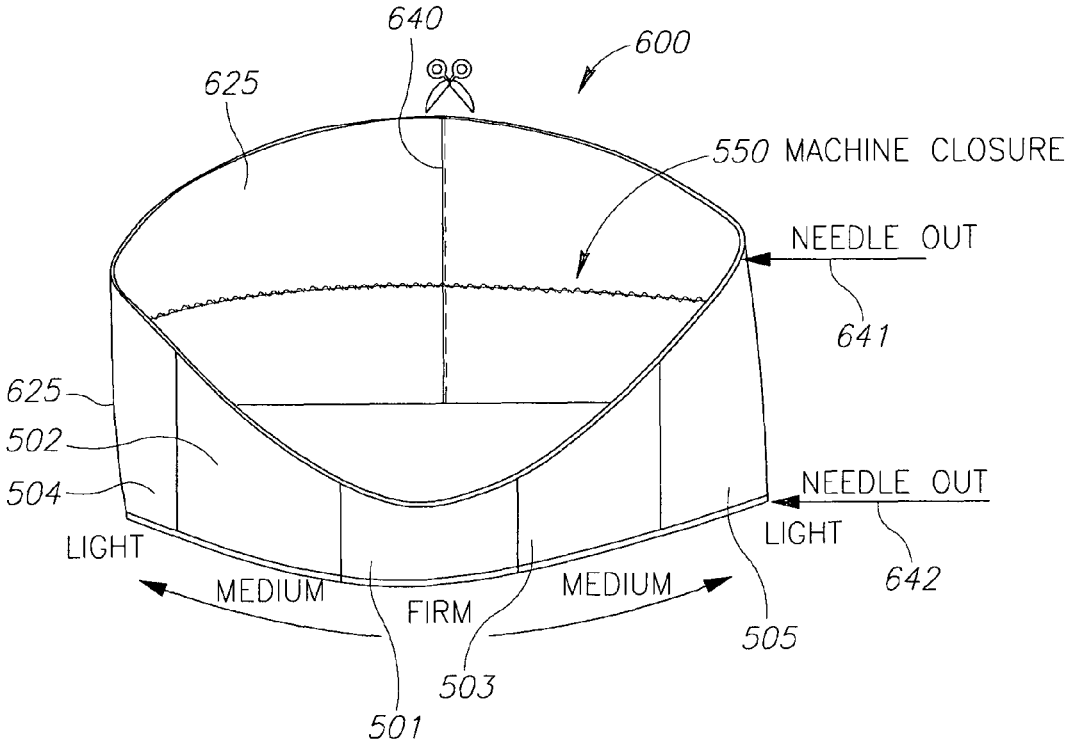
FIGS. 6A and 6B are schematic illustrations of a support belt showing a rear view (FIG. 6A) and a side view (FIG. 6B) thereof, in accordance with some embodiments of the present invention.
Figure 6B:
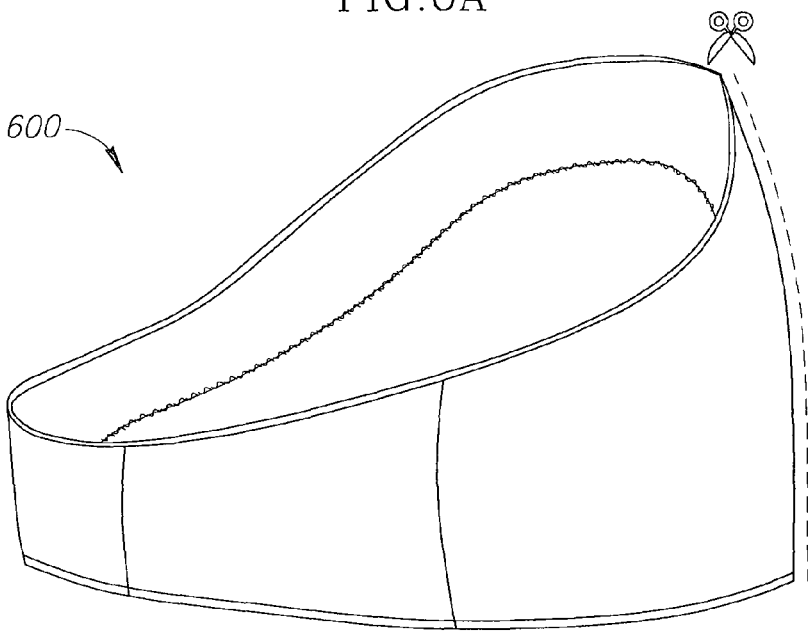

Reference is made to FIGS. 6A and 6B, which are schematic illustrations of a support belt 600 (or a support band) showing a rear view (FIG. 6A) and a side view (FIG. 6B) thereof, in accordance with some embodiments of the invention. Support belt 600 may include a back wing 624 and a front wing 625. Support belt 600 may be generally ring-shaped.

The height of the back wing 624 may gradually decrease and increase in a concave shape; whereas the height of the front wing 625 may gradually increase and decrease in a convex shape. The back wing 624 may include multiple areas 501-502 having differential elasticity or flexibility or rigidness or support. The front wing 625 may be cut or spliced along a cutting line 640, in order to produce an elongated wing. Edges 641 and 642 may indicate exit points of needles during the production process of the support belt 600.

Figure 7A:
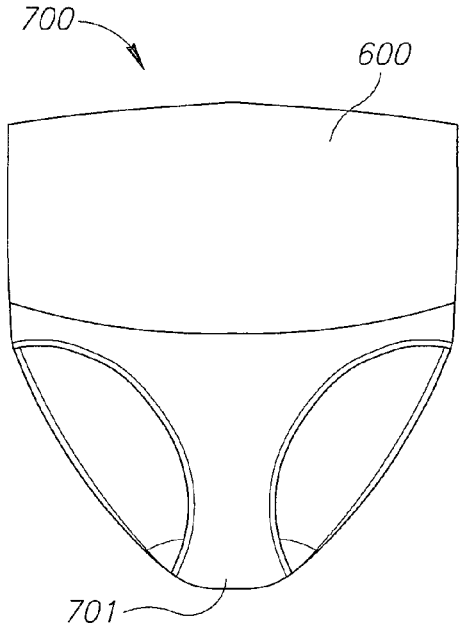
FIGS. 7A and 7B are schematic illustrations of a shaper showing a front view (FIG. 7A) and a rear view (FIG. 7B) thereof, in accordance with some embodiments of the present invention.
Figure 7B:
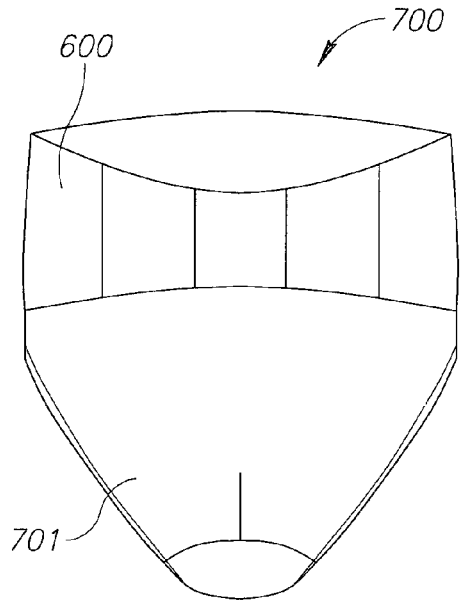

Reference is made to FIGS. 7A and 7B, which are schematic illustrations of a shaper 700 (or shaper garment) showing a front view (FIG. 7A) and a rear view (FIG. 7B) thereof, in accordance with some embodiments of the invention. Shaper 700 may include the support belt 600 of FIGS. 6A and 6B, connected on top of an underwear component 701 (or other suitable undergarment component). Shaper 700 may be formed as a single-piece article of clothing, or as two pieces (e.g., support belt 600 and underwear component 701) which may then be interconnected by sewing or knitting or stitching.

Figure 7C:
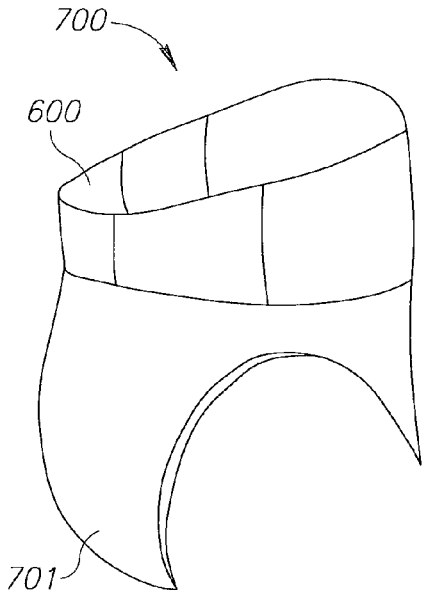
FIGS. 7C and 7D are schematic illustrations of a shaper showing a side view (FIG. 7C) and a rear view (FIG. 7D) thereof, in accordance with some embodiments of the present invention.
Figure 7D:
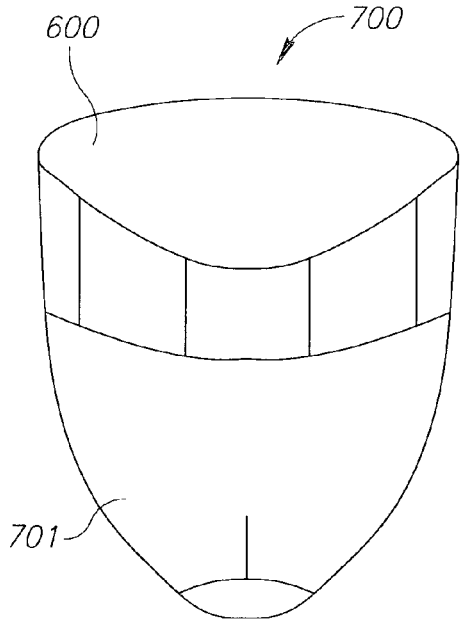

Reference is made to FIGS. 7C and 7D, which are schematic illustrations of a shaper 710 showing a side view (FIG. 7C) and a rear view (FIG. 7D) thereof, in accordance with some embodiments of the invention. Shaper 710 may include the support belt 600 of FIGS. 6A and 6B, connected on top of underwear component 701.

Figure 8A:
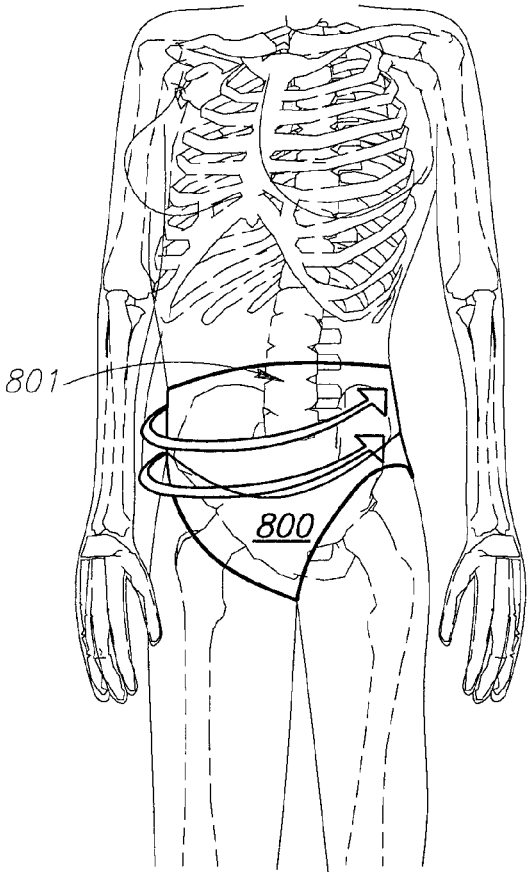
FIGS. 8A and 8B are schematic illustrations of a shaper showing a front view (FIG. 8A) and a rear view (FIG. 8B) thereof as worn on a person's body, in accordance with some embodiments of the invention.
Figure 8B:
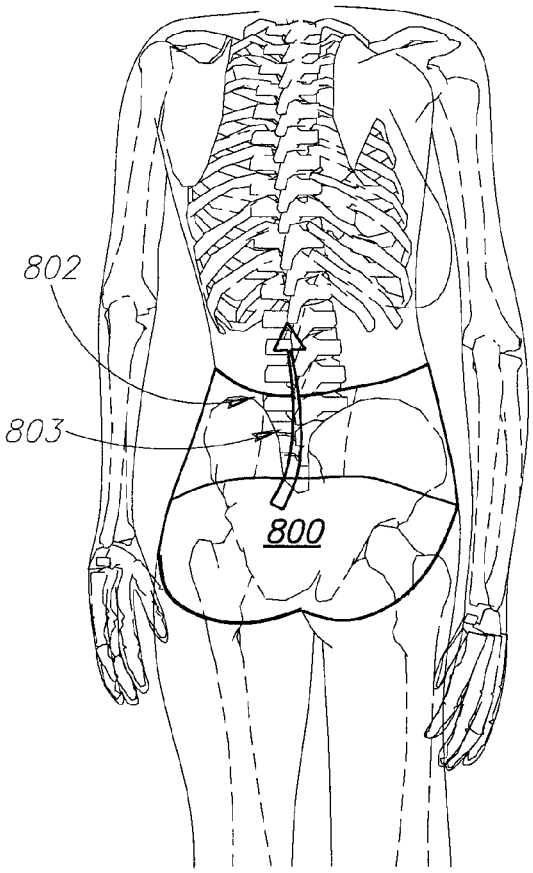

Reference is made to FIGS. 8A and 8B, which are schematic illustrations of a shaper 800 showing a front view (FIG. 8A) and a rear view (FIG. 8B) thereof as worn on a person's body, in accordance with some embodiments of the invention. Shaper 800 may provide one or more benefits or advantages, for example, increased stomach control or support (optionally by utilizing a double layer of fabric) (point 801); ergonomic waistband on the back part (point 802); and support and posture for the lower back (point 803). The invention may provide other and/or additional benefits or advantages.

Optionally, the plurality of areas comprise at least three areas which comprise: a central area having reduced elasticity; a right-side area having increased elasticity; and a left side area having increased elasticity.

Optionally, the plurality of areas comprise at least five areas which comprise: a central area 501 having reduced elasticity; a rightmost area 505 having increased elasticity; a leftmost area 504 having increased elasticity; a first intermediary area (the right-side intermediary area 503), located between the central area 501 and the rightmost area 505, wherein the first intermediary area has intermediate elasticity; and a second intermediary area (the left-side intermediary area 502, located between the central area 501 and the leftmost area 504, wherein the second intermediary area has intermediate elasticity.

Optionally, the plurality of areas comprise: a first area located at a central area of the backwing, and a second area located at a side area of the backwing.

Optionally, the backwing comprises a plurality of areas having differential elasticity which gradually decreases from a side-area of the backwing towards a center of the backwing.

The present invention may include other suitable garments, such as a shaper or underwear, in which a waistband or a back-area of the waistband may include multiple areas having differential elasticity or differential firmness or differential support or differential rigidness.

Although portions of the discussion herein may relate, for demonstrative purposes, to a bra, it would be appreciated that the invention may be used in order to produce other garments or other articles of clothing, for example, a shaper, a support garment, a garment for pregnant women, a garment for a high-weight person, a garment for a person having body features requiring support, or the like. The invention may optionally be used in conjunction with shirts, underwear, panties, stretchable garments, lingerie, or other types of garments.

The invention may include a bra (or other garment) having a back-band or a back-wing formed as a single continuous piece of cloth or fabric; the back-band may have multiple areas, such that pressure and/or elasticity and/or width and/or support of one or more areas of the back-band may be different from pressure and/or elasticity and/or width and/or support of one or more other areas of the back-band. For example, this may be achieved by utilizing different types of threads for different areas of the back-band; by utilizing threads having different elasticity and/or width and/or weight for different areas of the back-band; by selectively utilizing an elastomeric thread for one or more areas of the back-band; by selectively applying pre-defined threading pattern(s) for one or more areas of the back-band; or the like. Optionally, the garment production process may utilize a Santoni machine with automatic needle selection, or other programmable multiple-needle machine able to selectively control the operation of each needle, thereby performing needle-by-needle selection and/or operation (e.g., controlling each needle to perform a "clear" type of threading, a "miss" type of threading, or a "tuck" type of threading).

The back-band or back-wing may be connected to two front cups of the bra, such that the two cups may be interconnected using a closing/opening mechanism, thereby allowing a user to open and close the bra from the front side. Alternatively, the back-band or back-wing may be cut into two portions, and a closing/opening mechanism may be connected to these two portions, thereby allowing a user to open and close the bra from the back side. The opening/closing mechanism may include one or more mechanisms as known in the art, for example, hooks, Velcro, knots, or the like.

The back-band of the bra may have differential elasticity, width, pressure, support function, recovery function, or other characteristics which may differ at various areas of the back-band.

A manufacturing machine suitable for manufacturing body-size garments (e.g., a Santoni seamless machine, or a machine able to produce a shirt or other body garment) may be used in order to produce a bra or at least a back-wing having differential support. The manufacturing machine may optionally produce a bra, or a back-band for a bra, which may already include two layers having a welt or a double-welt. Machine closure may be used, for example, to produce a welt or a double-welt substantially simultaneously with the sewing of the back-band and not subsequently to the sewing of the back-band. Optionally, the machine closure may include knitting of a very thin line or layer along the center of the back-band.

In some embodiments, the entire garment or bra or shaper may be manufactured using a single sewing machine or threading machine or other single garment-producing machine. In other embodiments, the garment may be manufactured by multiple machines or units, such that, for example, a first portion of the garment (or of the back-wing or the waist-band) having a first elasticity is produced by a first machine, and a second portion of the garment (or of the back-wing or the waist-band) having a second elasticity is produced by a second machine, or by a second or separate run or process on the first machine. In some embodiments, optionally, multiple areas of the garment having differential elasticity may be manufactured in a single process or by a single machine or concurrently, or alternatively, may be produced in series or my multiple machines and may then be bonded together, sewn together, glued together, or otherwise attached or coupled together.

In some embodiments, the differential elasticity or firmness of various portions or areas of the back-wing or back-region of the garment, may be achieved not by (or not only by) utilizing different types of threads or cloth or material(s) for producing those areas; but rather, for example, by utilizing a differential threading or differential sewing technique which produces high-density or less-elasticity portion(s), which produces low-density or high-elasticity portion(s). In some embodiments, the change from low to high elasticity, or vice versa, may be gradual and/or continuous; or alternatively, discrete portions may have discrete and differential non-gradual levels of elasticity or firmness.

In some embodiments, the backwing (or waist-band) may be produced as a single component, and does not comprise differential elasticity areas that are interconnected post-production. In other embodiments, the back-wing (or waist-band) may be produced as a component that includes pre-produced areas that are then sewn together or bonded together or glued together or otherwise attached together.

In accordance with some demonstrative embodiments of the present invention, as demonstrated, for example, in FIG. 2A, FIG. 2B, FIG. 4B, FIG. 5B and/or FIG. 6A, a bra may comprise: two cups located at a front side relative to the bra and relative to a wearer of the bra; and a backwing comprising a plurality of areas having differential elasticity, wherein the plurality of areas having differential elasticity comprises at least a central area, a rightmost area, a leftmost area, a right-side intermediary area, and a left-side intermediary area. As demonstrated in the drawings, the bra may have the following features. (A) The central area of said backwing is located at an east-to-west center of said backwing; wherein the central area comprises an entire height south-to-north of said backwing; wherein the central area has a first elasticity. (B) The rightmost area of said backwing is located at a right-side of said backwing which corresponds to a right side of a back of the wearer of the bra; wherein the rightmost area of the backwing is located entirely on the right side relative to the central area, the leftmost area, the right-side intermediary area, and the left-side intermediary area of the backwing; wherein the rightmost area of the backwing comprises the entire height south-to-north of said backwing; wherein the rightmost area of the backwing has a second elasticity which is greater than the first elasticity of the central area. (C) The leftmost area of said backwing is located at a left-side of said backwing which corresponds to a left side of the back of the wearer of the bra;

wherein the leftmost area of the backwing is located entirely on the left side relative to the central area, the rightmost area, the right-side intermediary area, and the left-side intermediary area of the backwing; wherein the leftmost area of the backwing comprises the entire height south-to-north of said backwing; wherein the leftmost area of the backwing has said second elasticity which is greater than the first elasticity of the central area. (D) The right-side intermediary area of said backwing is located east-to-west between (i) the central area of the backwing and (ii) the rightmost area of the backwing; wherein the right-side intermediary area of the backwing is located entirely on the right relative to the central area and relative to the leftmost area of the backwing; wherein the right-side intermediary area of the backwing is located entirely on the left relative to the rightmost area of the backwing; wherein the right-side intermediary area of the backwing comprises the entire height south-to-north of said backwing; wherein the right-side intermediary area of the backwing has a third elasticity which is greater than the first elasticity of the central area and is less than the second elasticity of the rightmost area. (E) The left-side intermediary area of said backwing is located east-to-west between (i) the central area of the backwing and (ii) the rightmost area of the backwing; wherein the left-side intermediary area of the backwing is located entirely on the left relative to the central area and relative to the righmost area of the backwing; wherein the left-side intermediary area of the backwing is located entirely on the right relative to the leftmost area of the backwing; wherein the left-side intermediary area of the backwing comprises the entire height south-to-north of said backwing; wherein the left-side intermediary area of the backwing has said third elasticity which is greater than the first elasticity of the central area and is less than the second elasticity of the leftmost area.

Functions, operations, components and/or features described herein with reference to one or more embodiments, may be combined with, or may be utilized in combination with, one or more other functions, operations, components and/or features described herein with reference to one or more other embodiments, or vice versa.

While certain features of some embodiments have been illustrated and described herein, many modifications, substitutions, changes, and equivalents may occur to those skilled in the art. Accordingly, the claims are intended to cover all such modifications, substitutions, changes, and equivalents.

What is claimed is:

1. A bra comprising:

two cups located at a front side relative to the bra and relative to a wearer of the bra; and a backwing comprising a plurality of areas having differential elasticity, wherein the plurality of areas having differential elasticity comprises at least a central area, a rightmost area, a leftmost area, a right-side intermediary area, and a left-side intermediary area;

(A) wherein the central area of said backwing is located at an east-to-west center of said backwing;

wherein the central area comprises an entire height south-to-north of said backwing;

wherein the central area has a first elasticity;

(B) wherein the rightmost area of said backwing is located at a right-side of said backwing which corresponds to a right side of a back of the wearer of the bra;

wherein the rightmost area of the backwing is located entirely on the right side relative to the central area, the leftmost area, the right-side intermediary area, and the left-side intermediary area of the backwing;

wherein the rightmost area of the backwing comprises the entire height south-to-north of said backwing;

wherein the rightmost area of the backwing has a second elasticity which is greater than the first elasticity of the central area;

(C) wherein the leftmost area of said backwing is located at a left-side of said backwing which corresponds to a left side of the back of the wearer of the bra;

wherein the leftmost area of the backwing is located entirely on the left side relative to the central area, the rightmost area, the right-side intermediary area, and the left-side intermediary area of the backwing;

wherein the leftmost area of the backwing comprises the entire height south-to-north of said backwing;

wherein the leftmost area of the backwing has said second elasticity which is greater than the first elasticity of the central area;

(D) wherein the right-side intermediary area of said backwing is located east-to-west between (i) the central area of the backwing and (ii) the rightmost area of the backwing;

wherein the right-side intermediary area of the backwing is located entirely on the right relative to the central area and relative to the leftmost area of the backwing;

wherein the right-side intermediary area of the backwing is located entirely on the left relative to the rightmost area of the backwing;

wherein the right-side intermediary area of the backwing comprises the entire height south-to-north of said backwing;

wherein the right-side intermediary area of the backwing has a third elasticity which is greater than the first elasticity of the central area and is less than the second elasticity of the rightmost area;

(E) wherein the left-side intermediary area of said backwing is located east-to-west between (i) the central area of the backwing and (ii) the rightmost area of the backwing;

wherein the left-side intermediary area of the backwing is located entirely on the left relative to the central area and relative to the righmost area of the backwing;

wherein the left-side intermediary area of the backwing is located entirely on the right relative to the leftmost area of the backwing;

wherein the left-side intermediary area of the backwing comprises the entire height south-to-north of said backwing;

wherein the left-side intermediary area of the backwing has said third elasticity which is greater than the first elasticity of the central area and is less than the second elasticity of the leftmost area.

2. The bra of claim 1, wherein the backwing comprises said plurality of areas having differential elasticity which gradually decreases from an east-to-west right-side of the backwing towards the central area of the backwing.

3. The bra of claim 1, further comprising two or more straps arching from the two cups to the backwing.

4. The bra of claim 1, wherein the bra is strapless.

5. The bra of claim 1, wherein the backwing is produced as a single component.

6. The bra of claim 1, wherein the backwing has gradually-increasing elasticity from the central area sideways eastbound, and whereas the backwing has gradually-increasing elasticity from the central area sideways westbound.

7. The bra of claim 1, wherein the backwing has gradually-decreasing rigidness from the central area sideways eastbound, and whereas the backwing has gradually-decreasing rigidness from the central area sideways westbound.

8. The bra of claim 1, wherein the plurality of areas of the backwing comprises said central area, said rightmost area, said leftmost area, said right-side intermediary area, and said left-side intermediary area that are produced by a single production process utilizing a single production machine.

9. The bra of claim 1, wherein the plurality of areas of the backwing comprises said central area, said rightmost area, said leftmost area, said right-side intermediary area, and said left-side intermediary area that interconnected by glue.

10. The bra of claim 1, wherein the plurality of areas of the backwing comprises said central area, said rightmost area, said leftmost area, said right-side intermediary area, and said left-side intermediary area that interconnected by sewing.

11. The bra of claim 1, wherein the plurality of areas of the backwing comprises said central area, said rightmost area, said leftmost area, said right-side intermediary area, and said left-side intermediary area that are all formed of the same material.

12. The bra of claim 1, wherein the plurality of areas of the backwing comprises said central area, said rightmost area, said leftmost area, said right-side intermediary area, and said left-side intermediary area that are all formed of the same material having differential threading.

13. The bra of claim 1, wherein the plurality of areas of the backwing comprises said central area, said rightmost area, said leftmost area, said right-side intermediary area, and said left-side intermediary area that are all formed of the same material having differential sewing.

* * * * *